United States Patent [19]

Janke

[11] 4,378,835

[45] Apr. 5, 1983

[54] FOUNDRY CORE OR MOLD MAKING MACHINE

[75] Inventor: Gilbert J. Janke, Parma, Ohio

[73] Assignee: The Osborn Manufacturing Corporation, Cleveland, Ohio

[21] Appl. No.: 173,176

[22] Filed: Jul. 28, 1980

[51] Int. Cl.[3] ..... B22D 13/12

[52] U.S. Cl. ..... 164/183; 164/186; 164/228; 164/200

[58] Field of Search ..... 164/183, 185, 186, 409, 164/200-202, 228, 16, 19-21, 224, 402

[56] References Cited

U.S. PATENT DOCUMENTS

| | | | |
|---|---|---|---|
| 3,089,205 | 5/1963 | Ellms | 164/202 X |
| 3,253,304 | 5/1966 | Hatch | 164/202 X |
| 3,398,781 | 8/1968 | Bevis | 164/228 |
| 3,528,481 | 9/1970 | Lund | 164/183 |
| 3,613,770 | 10/1971 | Janke | 164/201 X |
| 3,627,022 | 12/1971 | Shields | 164/183 X |

FOREIGN PATENT DOCUMENTS

| | | | |
|---|---|---|---|
| 2145522 | 3/1972 | Fed. Rep. of Germany | 164/183 |

*Primary Examiner*—Gus T. Hampilos
*Assistant Examiner*—K. Y. Lin
*Attorney, Agent, or Firm*—Maky, Renner, Otto & Boisselle

[57] ABSTRACT

A foundry core or mold machine utilizes a horizontally extending frame pivoted at one end which fixedly supports one box half or cope and movably supports the other box half or drag. A power actuator pivots the frame to clamp the box halves closed against a blow head or gassing head which may be shuttled thereabove. The drag box half is mounted on a cradle on the frame for movement toward and away from the cope or fixed box half and for pivoting movement to bring the box to a core or mold discharge or an inspection or disassembly position when the box halves are not clamped against the blow head or gassing head. Each box half includes a machine actuated stripping mechanism to insure removal of the core or mold both from the cope and drag with the latter then placing the core on a discharge conveyor. The conveyor may be of the flat belt type canted slightly to present a flat surface to receive the core or mold.

45 Claims, 7 Drawing Figures

FOUNDRY CORE OR MOLD MAKING MACHINE

This invention relates generally to a foundry core or mold making machine and more particularly to a machine which can quickly and efficiently produce cores or molds of large size. The present invention represents certain improvements in mold and core blowing machines of the type seen in Elms U.S. Pat. No. 3,089,205, Hatch U.S. Pat. No. 3,253,304, and Janke U.S. Pat. No. 3,613,770.

More particularly, the present invention adapts such machines for use with a gassing head such as employed in a cold box process utilizing $SO_2$ gas, for example.

In such process, the gas is employed to harden the sand which is mixed with approximately 1.2 to 1.5% phenolic or furan resin and peroxide in equal amounts to 25 to 40% of the resin.

BACKGROUND OF THE INVENTION

In high production foundries it is important to be able to produce large and complex size cores or molds in a minimal cycle time with repeatable accuracy. It is also important to be able to produce such cores with inexpensive and readily changeable tooling. In the cold box process such as that employed using $SO_2$ gas, the sand mix has the advantage of mixing in a conventional muller and it will not harden until gassed. With such process foundries can employ readily available tooling. Moreover, with the cold box process, metal tooling will not change in size because of the application of heat.

It is also important not only to be able to make the core or mold quickly, but to be able to deposit the core or mold on a conveyor for subsequent inspection and assembly without manual handling and without damage to the core or mold. Also, in job shop foundries where tooling changes frequently, it is important to be able to employ a machine wherein the tooling can quickly and readily be inspected or removed and replaced if required.

SUMMARY OF THE INVENTION

The machine of the present invention utilizes a C-shape frame with a gassing head and blow reservoir being supported side-by-side at the top of the frame for horizontal shuttling movement. A tooling frame extends generally horizontally of the machine and into the opening of the C. The tooling frame supports in a stationary manner the cope or fixed box half and in a movable manner the movable or drag box half which are clamped together in a plane extending vertically below the blow head or gassing head. The tooling frame is pivoted by a relatively short stroke vertically movable power actuator which pivots the tooling frame to clamp the box halves when closed against the blow head or gassing head.

The movable or drag box half is mounted on a cradle on the frame for movement toward and away from the cope or fixed box half and for pivoting movement to bring the box to a core or mold discharge or an inspection or disassembly position when the box halves are not clamped against the blow head or gassing head. Each box half includes a machine actuated stripping mechanism to ensure removal of the core both from the cope and drag with the latter then placing the core or mold on a discharge conveyor. The conveyor may be of the flat belt type serving a single machine or a series of machines and may be canted somewhat at the discharge position to present a flat face to receive the core or mold. The drag box half can be positioned and stopped above the conveyor belt to present the core or mold at an ideal discharge height. The pivot of the tooling frame is slightly vertically offset so as to present the top surface of the box halves in a horizontal plane for clamping.

It is accordingly a principal object of the present invention to provide a core or mold making machine which can quickly produce large size cores or molds utilizing a a gassing process.

Another principal object is the provision of such machine where the separable box halves are supported for closing and for separation on a pivoting frame.

Still another important object is the employment of such frame to clamp the box halves against either a blow head or gassing head.

Another object is the provision of such machine wherein the box halves are vertically split and wherein the box halves can readily be separated and the core is discharged onto a conveyor.

Another important object is the provision of such machine wherein the box parts can readily be inspected, removed or replaced.

Still another object is the provision of a core making machine utilizing vertically split box halves which can also employ a cold box gassing head.

A further object is the provision of such machine wherein the movable box half may be pivoted approximately 180° through and beyond a discharge position.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In said annexed drawings:

FIG. 1 is a side elevation of a machine in accordance with the present invention;

FIG. 4 is a front elevation of the machine as seen from the line 4—4 of FIG. 1;

DETAILED DESCRIPTION OF THE DRAWINGS

Figure 6:
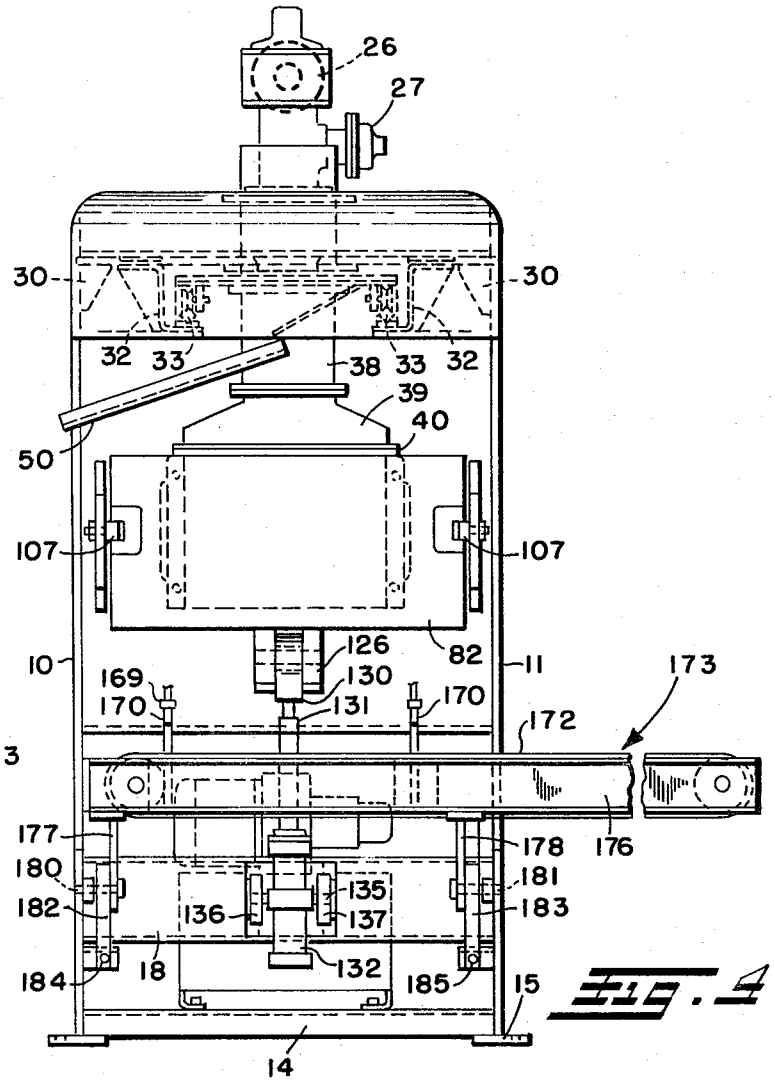
FIG. 6 is a fragmentary transverse section through the movable box half illustrating the stripping mechanism employed at the discharge position.

Referring first to FIGS. 1 through 4 it will be seen that the machine includes C-shape side frame plates 10 and 11 which are interconnected near the bottom by base frames 12, 13 and 14 of the angle configuration shown. Projecting feet are provided at the corners of the base of the frame as seen at 15 so that the machine may be leveled and secured to the floor.

Also extending between the side frames are structural rectangular tubular element 18, an angle frame member 19, and a cylindrical reservoir 20.

At the top the side plates 10 and 11 are interconnected by a head frame shown generally at 22 which includes transverse tubular frame members 23 and 24. Through the center of the latter extends a tube 25 is communication with the blow valve 26 and the exhaust 27. The blow valve is of course in communication with the reservoir 20 through the piping seen at 28.

Gussets 30 may be provided between the head frame and the side frame to rigidify the frame construction. Depending from the head frame as seen more clearly in FIG. 4 are brackets 32 supporting square in section rails 33. The rails in turn support V-groove rollers 34, four in number, two on each rail which in turn support shuttle carriage 35. The rollers 34 depend from a top plate 36 of the carriage which includes a gassing head 37 and a sand blow reservoir 38. The sand reservoir includes on its lower end a tapered yet laterally spreading bottom portion or nozzle 39 conforming the cylindrical configuration of the reservoir to the slot or blow holes in the top of the box halves clamped therebeneath. A seal assembly 40 is provided on the lower end thereof.

The carriage 35 is moved horizontally by a pneumatic piston-cylinder assembly 42, the rod of which is connected at 43 to the carriage. The piston-cylinder assembly 42 is trunion mounted at 44 to a bracket assembly which extends from the head frame 22.

Immediately outside of the blow and exhaust valves, the head frame 22 supports a sand fill chute 47. The chute 47 is situated within the hood 48 which closes the top of the machine. Properly mixed sand for the core making operation may be fed through the chute. The chute is normally closed by the top plate 36 when the reservoir 38 is in the blow position. Any sand spillage will be caught by the hood 48, or if not, will be caught by the deflector 50 to be moved laterally of the core or mold making operation.

It will be appreciated that the piston-cylinder assembly 42 shuttles the carriage 35 to and from a position in which the sand reservoir 38 is beneath the blow and exhaust valves and a position in which it is beneath the sand chute 47. When the reservoir 38 is beneath the sand chute 47, the gassing head 37 is in the position normally occupied by the sand reservoir.

Positioned below the shuttling carriage 35 is a horizontally extending tooling frame shown generally at 54. Seen more clearly in FIG. 3, the tooling frame includes two side plates 56 and 57 which are pivoted at 58 and 59, respectively to the side plates 10 and 11. The side plates of the tooling frame are interconnected by tubular frame members 62, 63 and 64 seen perhaps more clearly in FIG. 5.

Of the three transverse frames the frame 62 is the largest and is offset rearwardly from the other two vertically spaced frames 63 and 64. Secured to the lower side of the frame 62 at the center are mounting brackets 66 for the trunion support 67 of piston-cylinder assembly 68.

The rod 70 of the piston-cylinder assembly extends rearwardly of the machine and the reduced diameter end 71 thereof extends through a transverse yoke 72 and is secured thereto as seen at 73. Pivotally connected at each end of the yoke are elongated trunion links 75 and 76. The yoke 72, links 75 and 76, and the piston rod 70 project from the frame into a rearwardly projecting safety housing or hood 77 which is secured by suitable fasteners 78 to the edges of the side plates 10 and 11.

Figure 5:
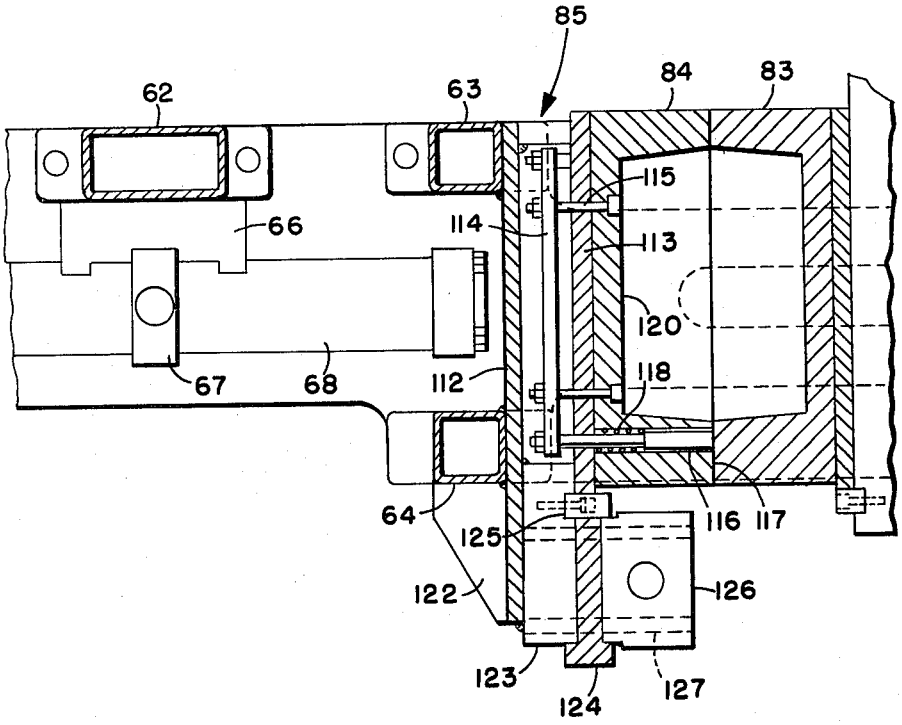
FIG. 5 is a fragmentary vertical section through the box halves in their closed position illustrating the machine operated stripping mechanism utilized with the fixed box half.
Figure 6:
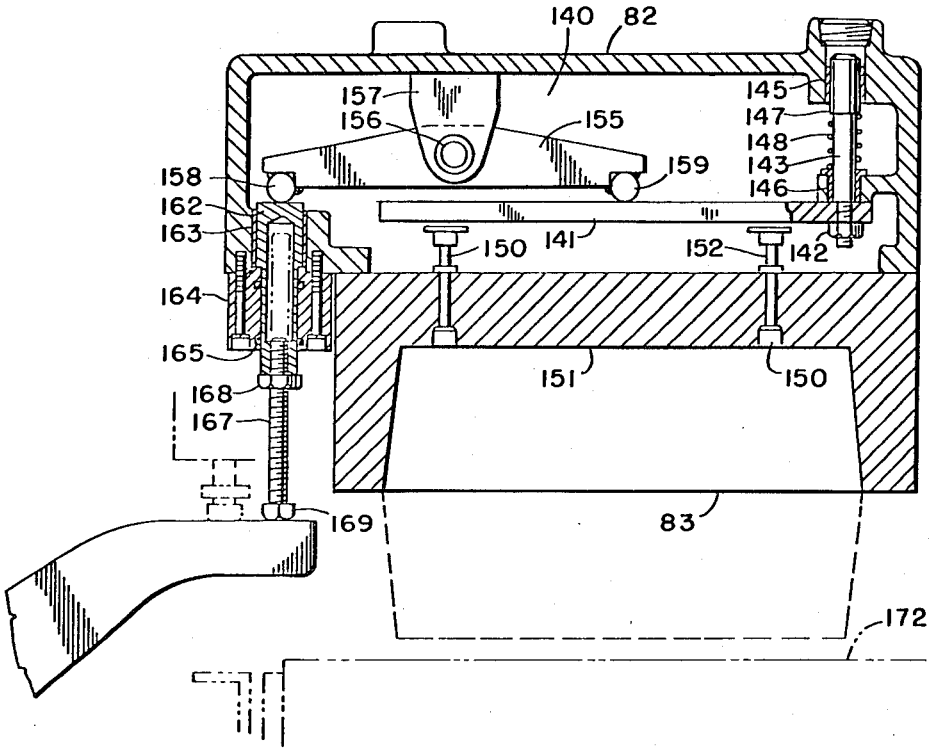
Figure 7:
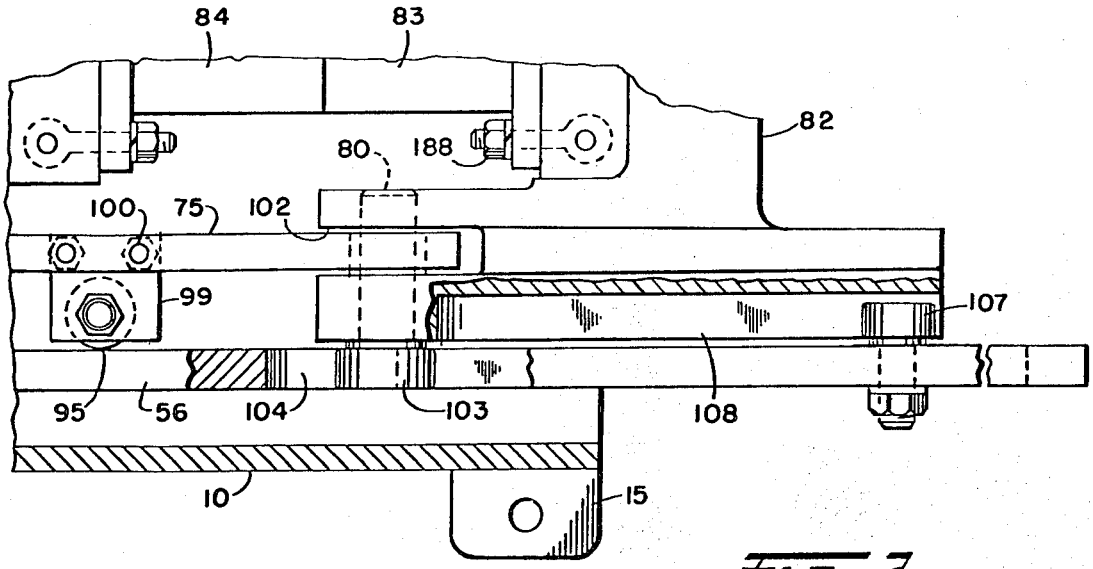

The trunion links extend from the yoke to trunions 80 and 81 of the cradle 82 which supports the movable drag box half 83. The stationary or cope box half 84 is secured to frame 85 mounted on the co-planar faces of the transverse frame member 63 and 64 as seen in FIG. 5. Each trunion link extends through a pair of vertically spaced stub shaft rollers as seen at 90 and 91 in FIG. 3. Such paired rollers are secured to the inside of the side frames 56 and 57 of the tooling frame and maintain the trunion links in proper alignment. Each trunion link also is provided with two side guide rollers as seen at 94, 95, and 96, 97, respectively.

Figure 7:
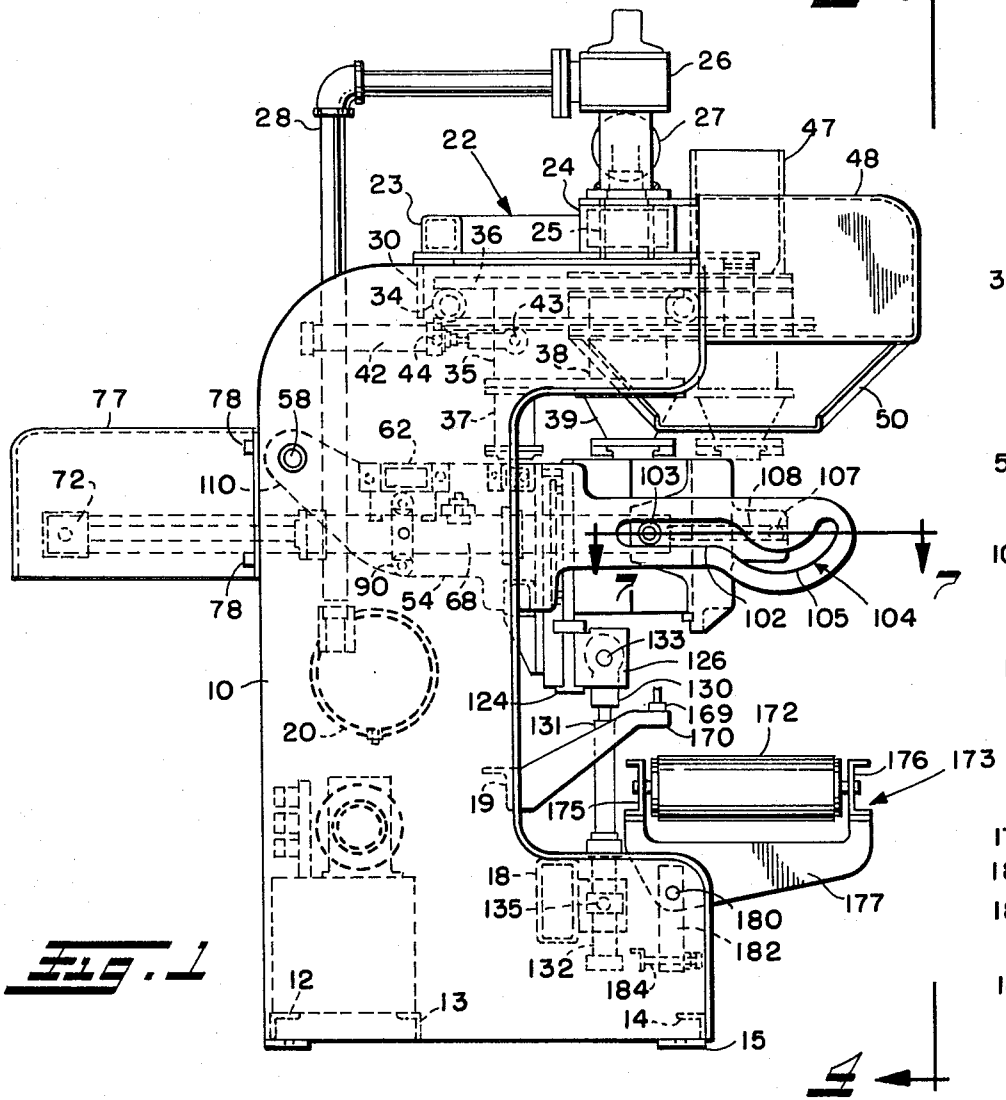
FIG. 7 is an enlarged horizontal section taken through the trunion of the cradle of the movable box half as seen from the line 7—7 of FIG. 1.

As seen more clearly in FIG. 7, such rollers are mounted on brackets 99 secured by fasteners 100 to the top of the trunion links. The rollers ride or bear against the inside surface of the side plates 56 and 57 of the tooling frame. Thus, the paired rollers 90 and 91 maintain the trunion links in proper alignment with the tooling frame while the rollers 94 through 97 maintain the proper spacing of the links between the side plates of the tooling frame. Such rollers may be of the type manufactured and sold by The Osborn Manufacturing Corporation of Cleveland, Ohio under the trademark LOAD RUNNERS.

Figure 2:
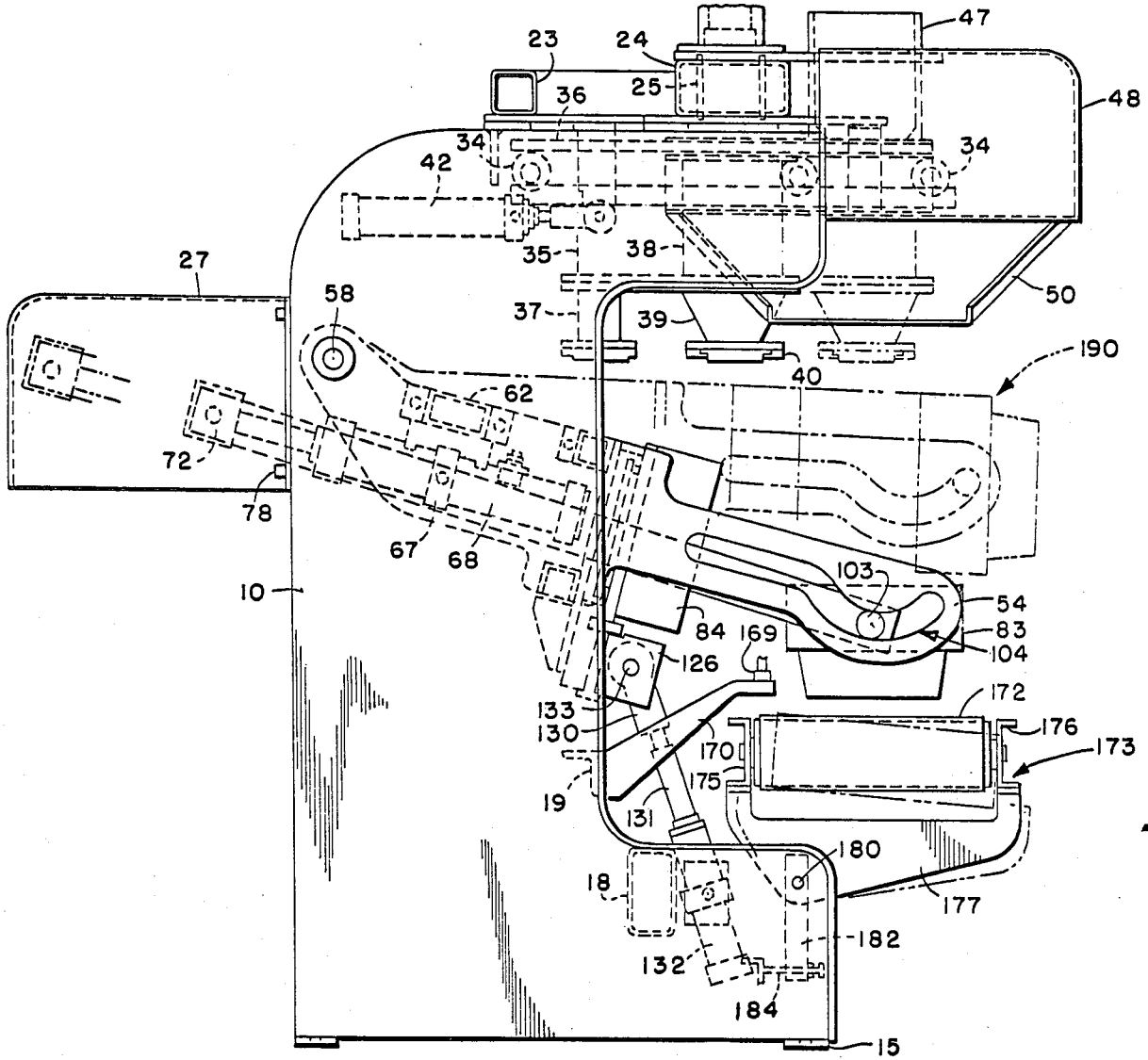
FIG. 2 is an enlarged side elevation of the machine showing the tooling frame and the movable box in several of its available positions.
Figure 3:
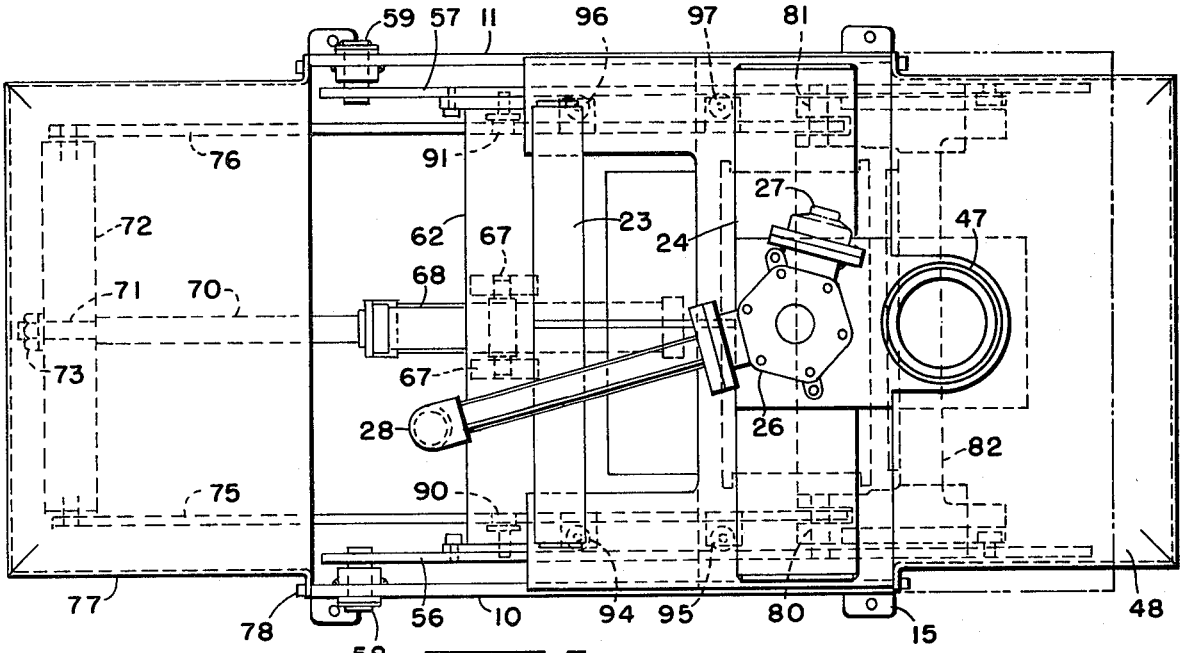
FIG. 3 is a top plan view of the machine.

As seen perhaps more clearly in FIG. 7, each trunion link extends into a slot 102 in the cradle 82 and is journaled on trunion 80 or 81. Each trunion includes an outwardly projecting roller as seen at 103 which rides within slot 104 in the respective side plate. The configuration of the slot is seen more clearly in FIGS. 1 and 2. The slot includes a circular portion 105 which extends around inwardly projecting roller 107. Each inwardly projecting roller 107 rides in linear slots 108 which extend parallel to and in line with the straight portion of the slot 102, at least in the closed position of the cradle seen in FIG. 1. Thus, as the cradle moves to the right, as seen in FIGS. 1 and 2, the cradle will be supported with the rollers 107 and 103 aligned in the direction of movement until the roller 103 enters the circular portion of the slot 102 thus pivoting the cradle downwardly about the axis of the rollers 107. Continued movement of the cradle to the right as seen in FIGS. 1 and 2 will cause the cradle to pivot substantially 180° with the roller 103 being then at the end of the slot 102 and on the opposite side of the roller 107.

It is noted that the side plates of the tooling frame include an upwardly offset portion 110 at the proximal end which offsets the pivots 58 and 59 to be substantially horizontally aligned with the top surfaces of the box halves 83 and 84 when they are clamped together and upwardly against either the sand reservoir or the gassing head.

Referring now to FIG. 5, it will be seen that the frame 85 supporting the fixed box half 84 includes two horizontally spaced frame plates 112 and 113, the former being open. Between such frames is accomodated a stripper plate 114 to which are secured stripper pins 115. Also secured to the stripper plate 114 are four stripper plungers 116 which when the box halves are open project slightly beyond the face 117 of the fixed box half 84. The end of each plunger is enlarged and a compression spring 118 is situated between the enlarged end and the plate 113. Thus, as the box halves close together to the position seen in FIG. 5, the compression springs 118 are compressed. This restricts the stripper pins to the flush position shown with the surface of the cavity 120. When the box halves separate, the compression springs move the plungers and thus the plate 114 as well as the stripper pins 115 outwardly or to the right as seen. The pins thus eject the core from the cavity 120 of the fixed box half 84.

At the lower end, the frame plate 112 projects beyond the transverse frame 64 and is rigidified thereto by a gusset 122. Secured to the face of the depending projection of the frame 112 is a block 123. The face of the block 123 is provided with an inverted T-shape spacer 124 which is held in place vertically by key 125. Trunion blocks 126 are secured to the block 123 through the spacer 124 by suitable fasteners passing through the apertures 127.

Situated between the trunion blocks is the eye 130 connected to the rod 131 of relatively short stroke piston-cylinder assembly 132. The eye is pin connected to the trunion blocks as indicated at 133.

The piston-cylinder assembly 132 is trunion mounted at 135 to trunion blocks 136 and 137 secured to the face of the rectangular transverse frame member 18. In this manner, the tooling frame 54 may be pivoted about the pivots 58 and 59 by extension and retraction of the piston-cylinder assembly 132.

Referring now to FIGS. 1, 4 and 6, it will be seen that the cradle 82 is hollow and supported in the hollow portion 140 is a stripper plate 141. The stripper plate is secured at 142 to one end of plungers 143 which are mounted in bushings 145 and 146. Each plunger is provided with a shoulder as seen at 147 and a compression spring 148 extends between the shoulder and the flange of bushing 146. There may be four such plungers supporting the stripper plate 141 at each corner.

The drag includes stripper pins 150 normally flush with the interior surface 151 of the drag. Each stripper pin is provided with a head 152 normally slightly out of engagement with the plate 141.

Situated within the hollow 140 are two rocker arms 155 pivoted centrally at 156 to brackets 157. Ball contacts 158 and 159 may be secured to each end of the rocker arm. The ball contacts 159 are designed to engage the centerline of the stripper plate 141.

Each other ball contact 158 engages the top of plungers 162. Each plunger includes an enlarged end mounted in bushing 163 and a reduced end mounted in plunger retainer 164. The reduced shank of the plunger is sealed in the retainer as seen at 165. The plunger is hollow and internally threaded to receive adjustable contact stud 167. Lock nut 168 holds the stud in adjusted position. The head 169 on the lower end thereof is designed to contact one of the projecting brackets 170 extending from transverse frame 19 as seen more clearly in FIGS. 1 and 4. As the cradle 82 moves downwardly in the inverted position as seen in FIG. 6, the brackets contact the head 169 elevating each plunger rocking the arms 155 depressing the plate 141 against stripping pins causing them to eject the core or mold onto the surface 172 of conveyor 173.

As seen more clearly in FIGS. 1 and 4, the side frames 175 and 176 of the conveyor are mounted on C-shape brackets 177 and 178 which are pivoted at 180 and 181, respectively to the insides of the side plates 10 and 11 of the machine frame. Each bracket includes a depending arm rigidly secured thereto as seen at 182 and 183 and the angular position of such arms and thus the brackets may be adjusted by the adjustment mechanisms seen at 184 and 185 so that the conveyor may be tilted or canted.

Since the cradle supporting the movable drag box half moves downwardly about the pivot 58, with certain deep cores, it may be advisable to tilt the conveyor to position it parallel to a surface of the core and to assure clearance when the cradle is elevated in its arcuate path about the pivot 58. In any event, the core is deposited on the conveyor in its selected position. It will be appreciated that the conveyor may extend through and service a plurality of machines.

As seen more clearly in FIG. 2, the piston-cylinder assembly 68 may be fully retracted to the extreme limit of slot 104. This positions the box half, with or without the core or mold, in the phantom line position 190 facing horizontally outwardly. In this position the box or core or mold may be inspected or the latter may be manually removed. Such position also facilitates removal and replacement of the tooling. In the clamped together position of the box halves, the fixed box half may be removed from its frame 85 by loosening the hex nut and pivoting the swing bolts 188 seen in FIG. 7 90° at four places. Plate 114 with the stripping pins attached, are part of the core box. The box halves are then secured together by straps or special fasteners and then both are moved to the position 190 for removal. The process is reversed for replacement.

Operation

The cycle of the machine is briefly as follows. The relatively large piston-cylinder assembly 68 and the relatively short stroke piston-cylinder assembly 132 may both be hydraulic. With the piston-cylinder assembly extended clamping the box halves together and with the sand reservoir 38 in position above the parting plane of the boxes, the piston-cylinder assembly 132 is extended to clamp the closed box halves against the blow reservoir. At this point the blow valve is opened followed immediately by the opening of the exhaust valve. The box halves with the sand resin mixed therein is then lowered slightly by partial retraction of the piston-cylinder assembly 132. The pneumatic cylinder 42 is now extended substituting or shuttling the gas head into position above the box halves while at the same time shuttling the sand reservoir to a position beneath the fill chute 47. The boxes are then again elevated by extension of the piston-cylinder assembly 132 to clamp them against the gassing head. At this time the curing gas such as the aforementioned $SO_2$ is forced into the sand resin mix, and is purged. Also at the same time the sand is fed through the chute 47 into the reservoir 38.

After the curing of the core, the still clamped together box halves are lowered slightly by partial retraction of the piston-cylinder assembly 132. At this time, the piston-cylinder assembly 68 now retracts moving the cradle 82 to the right. As the box halves separate the stripping mechanism seen in FIG. 5 causes the stripping pins 115 to follow the box half 83 causing the core or mold to remain in the cavity 151 of the drag half. Continued movement of the drag half away from the cope clears the core or mold therefrom and further movement rotates the cradle and the movable box half about the roller 107. When the cradle achieves its inverted or downwardly facing position moving to a pre-determined height above the discharge conveyor, the piston-cylinder assembly 132 is then hydraulically locked until the core or mold is discharged. FIG. 6 shows the brackets 170 contacting the plunger studs causing the plate 141 to move downwardly stripping the core from the drag half of the box onto the top surface 172 of the conveyor. Again, depending upon the particular core employed, the conveyor may be tilted at a slight angle to receive the core. After the core is mechanically ejected, the piston-cylinder 132 partially elevates. The piston-cylinder 42 retracts moving the blow reservoir into place. The piston-cylinder assembly 68 then extends closing and firmly clamping the box halves together. Then further extension of the cylinder 132 clamps the closed box halves against the blow head to repeat the cycle.

In any event, with the present invention, large cores or molds can be made with a cold box process in a cycle time of approximately 12 seconds.

I claim:

1. A foundry core or mold blowing machine comprising a blow head, a pivoting frame, separable mold halves supported for closing and for separation on said pivoting frame, and means to pivot said frame in one direction to clamp such halves when closed against said blow head, said frame extending generally horizontally and pivoted at one end.

2. A foundry machine as set forth in claim 1 wherein the pivot of said frame is offset from the major extent of the frame.

3. A foundry machine as set forth in claim 1 wherein the pivot of said frame is aligned with a common side of the separable mold halves when closed.

4. A foundry machine as set forth in claim 3 the pivot of said frame is aligned with the top side of the separable mold halves when closed, and the alignment is horizontal when the closed halves are clamped against the blow head.

5. A foundry machine as set forth in claim 1 including means to pivot said frame in the opposite direction to present one of the halves with the mold or core therein to a conveyor for discharge.

6. A foundry machine as set forth in claim 5 wherein said means to pivot said frame in said one or the opposite direction comprises a hydraulic piston-cylinder assembly.

7. A foundry machine as set forth in claim 6 wherein said machine includes a machine frame supporting said pivoting frame, said piston-cylinder assembly being pivoted to said machine frame below said pivoting frame.

8. A foundry machine as set forth in claim 1 wherein said pivoting frame includes means to move one of said mold halves toward and away from the other to close and separate the same, respectively.

9. A foundry machine as set forth in claim 8 wherein said means to move said one of said mold halves includes a piston-cylinder assembly pivoted to said frame.

10. A foundry machine as set forth in claim 9 wherein the rod of said piston-cylinder assembly is connected to a yoke, and said yoke is connected to said one of said mold halves by links, each link being connected to an end of said yoke.

11. A foundry machine as set forth in claim 10 wherein said piston-cylinder assembly is positioned on the opposite side of the other of said mold halves from said one of said mold halves with the rod thereof extending away from the mold halves.

12. A foundry machine as set forth in claim 10 including guide means for said links to maintain the same substantially parallel to the axis of the piston-cylinder assembly.

13. A foundry machine as set forth in claim 12 wherein said pivoting frame includes side plates, said guide means including side guides riding against said side plates to maintain the links parallel and properly spaced therefrom.

14. A foundry machine as set forth in claim 13 wherein said one mold half is supported on a cradle, and said links are pivotally connected to said cradle.

15. A foundry machine as set forth in claim 14 including corresponding cam slots in said side plates, and a trunion roller in each cam slot mounted on the link-cradle pivot.

16. A foundry machine as set forth in claim 15 wherein said slots include a generally circular portion, inwardly projecting rollers on the side plates in the center of said generally circular portion, said linear slots in said cradle engaging said inwardly projecting rollers to cause said cradle to pivot as the trunion rollers move through the generally circular portion of said cam slots.

17. A foundry machine as set forth in claim 1 wherein said frame includes means to rotate one of said mold halves when separated from the other about a horizontal axis.

18. A machine as set forth in claim 17 including a discharge position and an inspection position for said one of said mold halves, and means selectively to rotate said one of said mold halves to such positions.

19. A foundry machine as set forth in claim 1 wherein said frame includes means to rotate one of said mold halves when separated from the other of said mold halves about a horizontal axis approximately 180°.

20. A machine as set forth in claim 19 including an inspection position near the end of said 180° arc of rotation, and an intermediate discharge position, and means selectively to rotate said one of said mold halves to such positions.

21. A machine as set forth in claim 20 including a conveyor at such discharge position, and means to adjust the angle of the surface of the conveyor.

22. A foundry machine as set forth in claim 1 including a shuttling carriage supporting said blow head for horizontal movement.

23. A foundry machine as set forth in claim 1 including a shuttling carriage supporting said blow head for movement, said carriage including a gassing head adapted to replace said blow head when said carriage is shuttled.

24. A foundry machine as set forth in claim 23 including a sand fill chute for said blow head, said blow head being positioned beneath said chute when said gassing head replaces said blow head.

25. A foundry machine as set forth in claim 1 including machine actuated stripper means for each mold half.

26. A foundry machine as set forth in claim 25 wherein said separable mold halves include a stationary and movable mold half, the stripper means for said stationary mold half being operated by the movable mold half, while the stripper means for the movable mold half is operated by a machine abutment.

27. A foundry machine as set forth in claim 1 including means to pivot said frame a short distance to clamp and unclamp such halves when closed, and means to pivot said frame a greater distance to present said separable half when separated to a discharge position.

28. A machine as set forth in claim 26 including a conveyor at such discharge position, and means to adjust the angle of the surface of the conveyor.

29. A foundry molding machine comprising a stationary cope and movable drag, a horizontally extending vertically movable frame pivoted at one end supporting said cope and drag, means on said frame to clamp the cope and drag together on a generally vertical parting plane for filling with sand, and means on said frame to separate the cope and drag and pivot the drag when separated.

30. A machine as set forth in claim 29 wherein said means to clamp the cope and drag together and to pivot the drag includes a piston-cylinder assembly pivoted to said frame.

31. A machine as set forth in claim 30 wherein the rod of said piston cylinder assembly is connected to a yoke, and said yoke is connected to said drag by links, each link being connected to one end of said yoke.

32. A foundry machine as set forth in claim 31 including guide means for said links to maintain the same substantially parallel to the axis of the piston-cylinder assembly.

33. A foundry machine as set forth in claim 31 wherein said piston-cylinder assembly is positioned on the opposite side of said cope from said drag with the rod thereof extending away from the cope and drag.

34. A foundry machine as set forth in claim 32 wherein said frame includes side plates, said guide means including side guides riding against said side plates to maintain the links parallel and properly spaced therefrom.

35. A foundry machine as set forth in claim 34 wherein said drag is supported on a cradle, and said links are pivotally connected to said cradle.

36. A foundry machine as set forth in claim 35 including corresponding cam slots in said side plates and a trunion roller in each cam slot mounted on the link-cradle pivot.

37. A foundry machine as set forth in claim 36 wherein said slots include a generally circular portion, inwardly projecting rollers on said side plates in the center of said generally circular portion, and linear slots in said cradle engaging said inwardly projecting rollers to cause said cradle to pivot as the trunion rollers move through the generally circular portion of said cam slots.

38. A foundry machine as set forth in claim 29 including a shuttling carriage above said vertically movable frame, a blow head on said carriage to fill said cope and drag with sand, and means vertically to move said frame to clamp said cope and drag against said blow head.

39. A foundry machine as set forth in claim 38 wherein said shuttling carriage includes a gassing head adapted to replace said blow head when said carriage is shuttled.

40. A foundry machine as set forth in claim 39 including a sand fill chute for said blow head, said blow head being positioned beneath said chute when said gassing head replaces said blow head.

41. A foundry core blowing machine comprising a blow head, a generally horizontally extending frame transverse of said blow head and pivoted at one end offset from the axis of said blow head, core box halves mounted on said frame, and means to pivot said frame toward said blow head to clamp the core box halves thereagainst.

42. A machine as set forth in claim 41 including means on said frame to separate said core box halves and then pivot one of them to a discharge position.

43. A foundry blow molding machine comprising a blow head, a generally horizontally extending pivoting frame which extends transversely of said blow head, stationary cope and movable drag box halves mounted on said frame, and means on said frame to move said drag toward and away from said cope and to pivot said drag to extend downwardly or horizontally in the opposite direction.

44. A machine as set forth in claim 43 including a blow head, and means vertically to move said frame to clamp the box halves against the blow head.

45. A machine as set forth in claim 44 including means further to move said frame when said drag extends downwardly to position it for discharge.

* * * * *